United States Patent [19]

Kodama et al.

[11] Patent Number: 4,919,106

[45] Date of Patent: Apr. 24, 1990

[54] IGNITION DISTRIBUTOR FOR AN INTERNAL COMBUSTION ENGINE

[75] Inventors: Seiki Kodama; Shigemi Murata, both of Himeji, Japan

[73] Assignee: Mitsubishi Denki Kabushiki Kaisha, Tokyo, Japan

[21] Appl. No.: 333,809

[22] Filed: Apr. 6, 1989

Related U.S. Application Data

[63] Continuation of Ser. No. 177,044, Apr. 4, 1988, abandoned.

[30] Foreign Application Priority Data

Apr. 17, 1987 [JP] Japan ..... 62-95827

[51] Int. Cl.[5] ..... F02P 7/06; F02P 5/04

[52] U.S. Cl. ..... 123/617; 123/146.5 A

[58] Field of Search ..... 123/617, 146.5 R, 146.5 A; 200/190 R

[56] References Cited

U.S. PATENT DOCUMENTS

| | | | |
|---|---|---|---|
| 4,129,107 | 12/1978 | Boyer | 123/617 |
| 4,165,726 | 8/1979 | Helmer, Jr. | 123/617 |
| 4,235,213 | 11/1980 | Jellissen | 123/146.5 A |
| 4,275,703 | 6/1981 | Bodig et al. | 123/617 |
| 4,359,978 | 11/1982 | Brammer et al. | 123/617 |
| 4,428,332 | 1/1984 | Brammer | 123/617 |
| 4,570,118 | 2/1986 | Tomczak et al. | 123/617 |
| 4,677,946 | 7/1987 | Tamagne | 123/617 |
| 4,742,811 | 5/1988 | Okada et al. | 123/617 |

FOREIGN PATENT DOCUMENTS

| | | | |
|---|---|---|---|
| 2935412 | 3/1981 | Fed. Rep. of Germany | 123/146.5 A |

*Primary Examiner*—Raymond A. Nelli

*Attorney, Agent, or Firm*—Oblon, Spivak, McClelland, Maier & Neustadt

[57] ABSTRACT

An ignition distributor for an internal combustion engine has a magnetic-permeable flat plate fixed to the rotating shaft of the ignition distributor so as to extend in the direction perpendicular to the shaft, and a sensor having forked sensing parts which are extended inside the housing so as to adjoin a part of the flat plate.

2 Claims, 3 Drawing Sheets

IGNITION DISTRIBUTOR FOR AN INTERNAL COMBUSTION ENGINE

This application is a continuation of application Ser. No. 177,044, filed on Apr. 4, 1988, now abandoned.

1. FIELD OF THE INVENTION

The present invention relates to an ignition distributor for an internal combustion engine.

2. DISCUSSION OF BACKGROUND

FIG. 3 is a longitudinal cross-sectional view of a conventional ignition distributor. In FIG. 3, a reference numeral 1 designates an ignition distributor housing, a numeral 2 designates a cap connected to the housing 1, a numeral 3 designates a shaft housed in and held by the housing 1 to be rotated by an internal combustion engine for an automobile, a numeral 4 designates a reluctor made of a magnetic-permeable material which is fixed to the shaft 3, and a numeral 5 designates a sensor mounted on the housing 1 to face the reluctor 4 so that a signal for discriminating a cylinder as a standard in the internal combustion engine is generated when the shaft 3 is rotated. The signal from the sensor 5 is supplied to a fuel injecting device corresponding to the cylinder so that fuel is injected when the valve of the cylinder is opened.

A numeral 6 designates a magnet signal type generator for generating an ignition signal for each of the cylinders, a numeral 7 designates an ignition-timing control unit for controling the ignition signal, a numeral 8 designates a centrifugal spark-advance controller, a number 81 designates a governer base fixed to the shaft 3 and numerals 82, 83 are respectively weights.

The sensor 5 is attached to the outer surface of the cylindrical part of the ignition distributor housing 1 so that the sensing surface 51 of the sensor 5 is exposed in the housing 1. The reluctor 4 is fixed to the governer base 81 of the centrifugal spark-advance controller 8 so as to face the sensor 5 i.e., the reluctor 4 is bent to be an L-shape wherein one end is connected to the governor base 81 and the other end extends along the inner wall of the housing to face the sensor 5.

Thus, in the conventional distributor, it was necessary to bend a plate-like material into a cylindrical form in order to manufacture the reluctor 4, since the other end of the reluctor 4 extended in parallel to the axial direction of the distributor. Further, it was difficult to form the reluctor 4 having accurate dimensions for the part extending in the circumferential direction so as to correspond to the curved portion of the sensor 5 because the reluctor 4 has to be formed by bending operations.

In addition, in the conventional distributor, the shape of the signal obtained by the relative revolution of the reluctor 4 and the sensor 5 could not be sharp. Accordingly it did not meet requirements that digital treatments for the signal should be speedy. Furthermore, there was a problem that no signal is produced when the revolution speed of the shaft 3 is zero.

OBJECT OF THE INVENTION

It is an object of the present invention to provide an ignition distributor for an internal combustion engine which is capable of generating a signal suitable for digital treatment and which is of a simple structure.

SUMMARY OF THE INVENTION

The foregoing and the other objects of the present invention have been attained by providing an ignition distributor for an internal combustion engine comprising a housing of a generally cylindrical form, a shaft rotated by the internal combustion engine in the housing, a sensor attached to the cylindrical part of the housing, and a magnetic-permeable member fixed to the shaft and extended to face the sensor arranged so that a signal for each cylinder of the internal combustion engine is generated when the shaft is rotated. The ignition distributor is characterized in that the magnetic-permeable member is a flat-plate-like member extending in the direction perpendicular to the shaft. The sensor comprises a permanent magnet and a hall element, and the sensor has a disk-shaped part which extends into the housing through an opening formed in the cylindrical part of the housing so as to adjoin the magnetic-permeable flat-plate-like member. The position of the opening formed in the housing is at the same level as the position of the flat-plate-like member fixed to the shaft.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
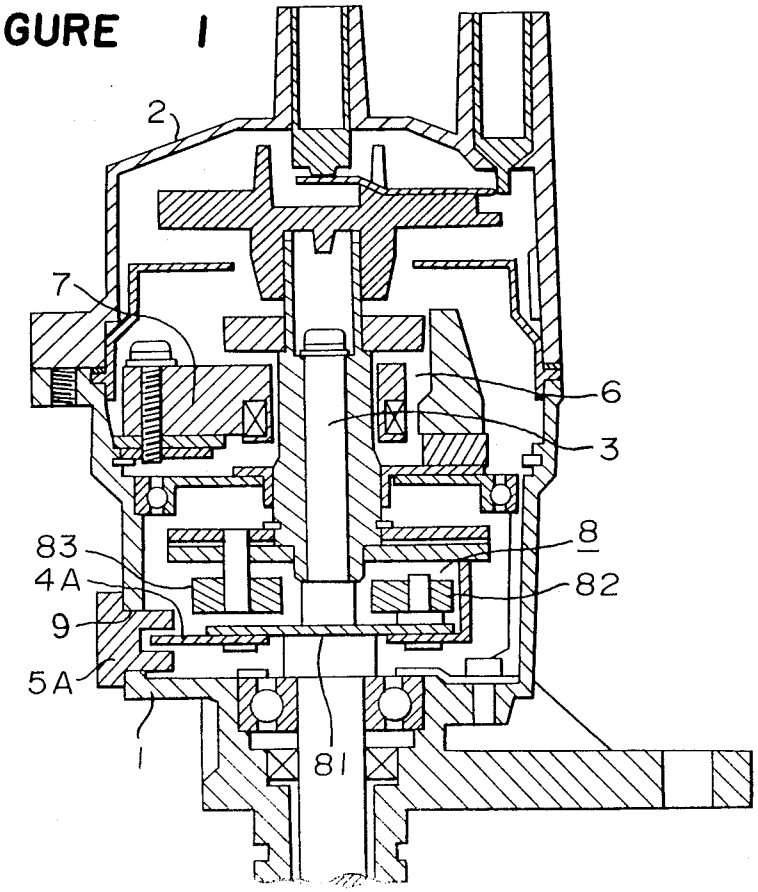
FIG. 1 is a longitudinal cross-sectional view of an embodiment of the ignition distributor for an internal combustion engine according to the present invention.

Referring to the drawings, wherein the same reference numerals designate the same or corresponding parts, and more particularly to FIG. 1 thereof, there is shown a longitudinal cross-sectional view of an embodiment of the ignition distributor for an internal combustion engine of the present invention. In FIG. 1, a reference numeral 4A designates a flat-plate-like reluctor or a magnetic permeable member which is formed by cutting or stamping a flat magnetic-permeable plate in a sector shape or a rectangular shape. The root potion of the sector-shaped magnetic-permeable member 4A or an end in the longitudinal direction of the rectangular magnetic-permeable member 4A is connected to the circumferential part of the governor base 81 which is in turn connected to the shaft 3 so that the magnetic-permeable flat-plate-like reluctor 4A extends in the direction perpendicular to the axial direction of the shaft 3.

A sensor 5A is attached on the cylindrical part of the distributor housing 1 from the outside to be fitted into an opening 9 formed therein so that the sensing part of the sensor 5A extends into the housing 1 through the opening 9 so as to adjoin the magnetic-permeable plate 4A. The position of the opening 9 is so determined as to be at the same level as the position of the magnetic-permeable plate 4A.

Figure 2A:
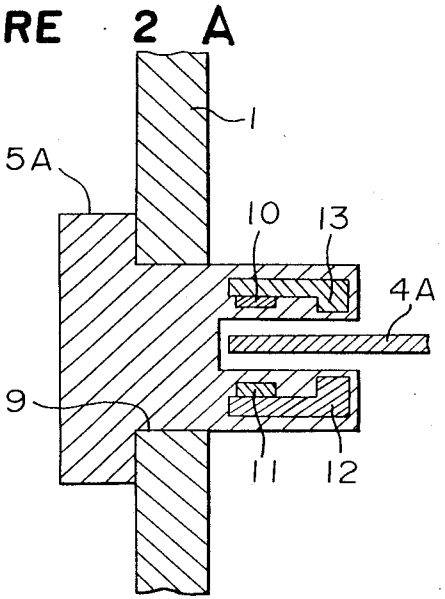
FIG. 2A is an enlarged cross-sectional view of a first embodiment of a sensor and a part of a magnetic-permeable member used for the ignition distributor of the present invention.

FIG. 2A is a cross-sectional view to illustrate a relation between the sensor 5A and the magnetic-permeable flat-plate-like reluctor 4A. The sensing part of the sensor 5A extending in the housing 1 is shaped in a ]-form or in a forked form so that the free end of the magnetic-permeable plate 4A passes between the two leg portions of the sensor 5A. A permanent magnet 11 and a first magnetic-permeable piece 12 are mounted on one of the leg portions of the sensor 5A and a hall element 10 and a second magnetic-permeable piece 13 are mounted on the other leg so that the permanent magnet 11 and the hall element 10 face each other. As is apparent from FIG. 2A, a part of the magnetic-permeable plate 4A can be passed between the leg portions of the sensor 5A.

When the plate 4A is between the hall element 10 and the permanent magnet 11, there is formed a closed magnetic path which passes through the permanent magnet 11, the first magnetic-permeable piece 12, and the magnetic-permeable flat-plate-like reluctor 4A. In this case, no voltage is produced in the hall element 10. When the magnetic-permeable flat-plate-like reluctor 4A is removed from the forked sensing part, there is formed a closed magnetic path passing through the permanent magnet 11, the first magnetic-permeable piece 12, the second magnetic-permeable piece 13, and the hall element 10, whereby there appears a voltage in the hall element 10. Thus, an electric signal is obtainable from the sensor 5A. The electric signal is produced even when the revolution speed of the shaft 3 is zero. Further, the shape of the output signal from the hall element is nearly rectangular in form, which is suitable for digital treatment.

Figure 2B:
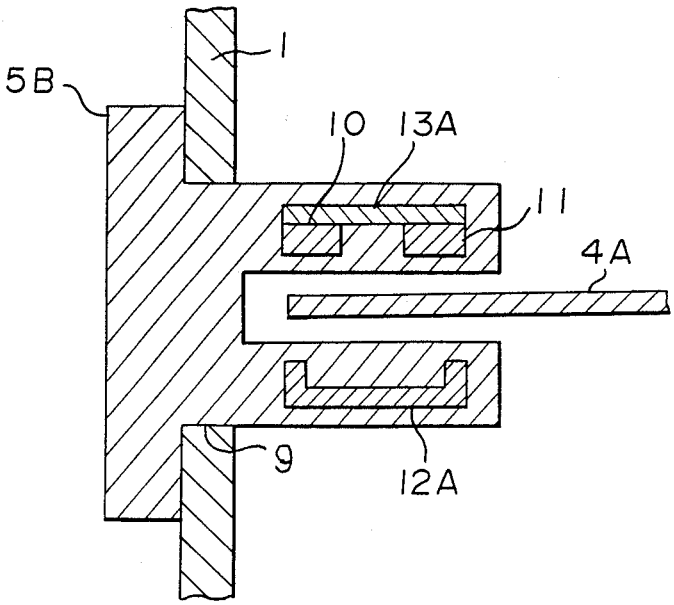
FIG. 2b is an enlarged cross-sectional view of a second embodiment of the sensor and a part of the magnetic-permeable member of the present invention.
Figure 3:
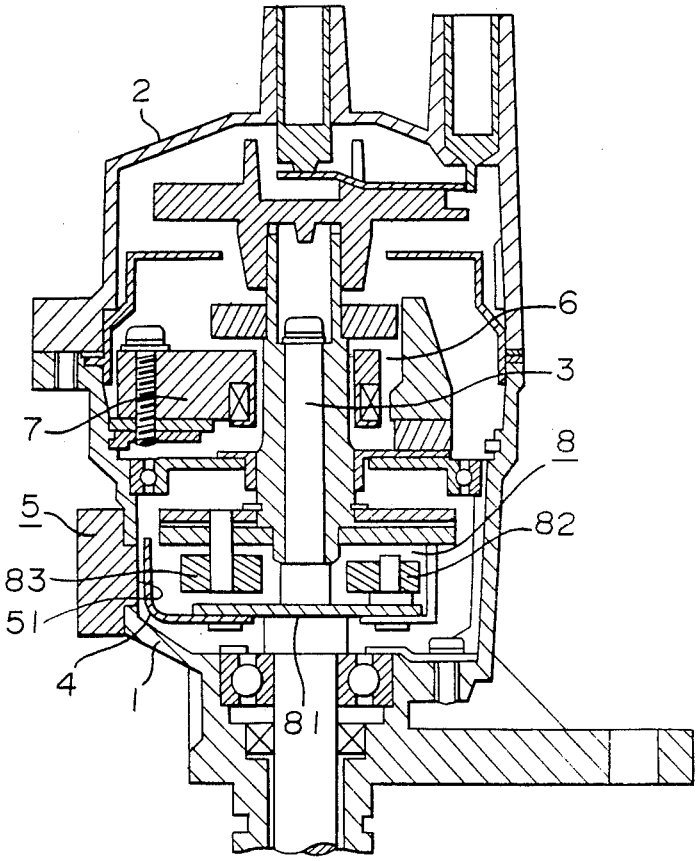
FIGURE 3 PRIOR ART
FIG. 3 is a longitudinal cross-sectional view of a conventional ignition distributor.

FIG. 2B shows another embodiment of the present invention. In FIG. 2B, the permanent magnet 11 as in FIG. 2A is removed. Instead, a channel-shaped magnetic-permeable piece 12 is provided in one of the leg. In the other leg of a sensor 5B, a second magnetic-permeable piece 13A in a flat-plate shape is provided, which is attached with the hall element 10 at its left end part (in FIG. 2B) and the permanent magnet 11 at its right end part, both facing the first magnetic-permeable piece 12A. In this embodiment, the same function can be obtained by forming a strong closed magnetic path when the magnetic-permeable flat-plate-like reluctor 4A come near the permanent magnet 11, whereby the hall element 10 produces a signal. When the magnetic-permeable flat-plate-like reluctor 4A separates from the permanent magnet 11, the magnetic path is opened, thereby stopping the generation of the signal from the hall element 10.

Thus, in the present invention, the magnetic-permeable plate is formed by cutting or stamping a flat plate, and, therefore, it is easily formed with a high accuracy. Further, use of the permanent magnet and the hall element provides a sharp waveform in the produced signal which is suitable for digital treatment. In addition, the cylinders of the internal combustion engine can be discriminated even when the revolution speed of the shaft is zero.

Obviously, numerous modifications and variations of the present invention are possible in light of the above teachings. It is therefore to be understood that, within the scope of the appended claims, the invention may be practiced otherwise than as specifically described herein.

What is claimed is:

1. An ignition distributor for an internal combustion engine, said injection distributor comprising:

(a) a housing of a generally cylindrical form;

(b) a shaft which, in use, is rotated around a central axis by said internal combustion engine in said housing;

(c) a sensor attached to the cylindrical part of said housing; and (d) a magnetic-permeable member fixed to said shaft and extending to face said sensor but to be spaced therefrom by a gap so that, in use, a signal for each cylinder of said internal combustion engine is generated when said shaft is rotated, wherein:

(e) said magnetic-permeable member comprises a flat-plate-like portion having a rectangular cross-section in a plane containing said central axis, a uniform thickness in the direction parallel to said central axis, and a uniform length in the direction perpendicular to said central axis, said length being much greater than said thickness;

(f) said cylindrical part of said housing has an opening formed therein at the same level as the position of said flat-plate-like portion; and (g) said sensor comprises:

(i) a radially outward portion having a rectangular cross-section in a plane that contains said central axis, said radially outward portion being located outside of said cylindrical part of said housing and being too large to fit through said opening;

(ii) a radially inward sensor portion which extends into said housing through said opening, said radially inward sensor portion having a uniform thickness in the direction parallel to said central axis at least approximately equal to the height of said opening and having a radially extending slot in its radially inward surface sized, shaped, and positioned so as to receive a part of said flat-plate-like portion and to divide said radially inward sensor portion into a first leg portion and a second leg portion;

(iii) a permanent magnet mounted in one of said first and second leg portions; and (iv) a hall element mounted in the other one of said first and second leg portions, whereby:

(i) said gap can be accurately and uniformly dimensioned and stably maintained and (ii) the shape of the signals obtained by the rotation of said magnetically-permeable member relative to said sensor is sufficiently distinct to be suitable for digital treatment.

2. The ignition distributor according to claim 1, wherein said flat-plate-like portion is in a sector form.

* * * * *